United States Patent [19]

Ohtomo et al.

[11] Patent Number: 5,017,256

[45] Date of Patent: May 21, 1991

[54] METHOD OF USING A HEAT-SENSITIVE MELT-TRANSFER RECORDING MEDIUM

[75] Inventors: Yasuyuki Ohtomo, Suita; Yoshiyuki Obata, Ibaraki, both of Japan

[73] Assignee: Fuji Kagakushi Kogyo Co., Ltd., Osaka, Japan

[21] Appl. No.: 289,505

[22] Filed: Dec. 23, 1988

Related U.S. Application Data

[63] Continuation of Ser. No. 46,814, filed as PCT JP86/00411 on Aug. 9, 1986 on Aug. 9, 1986, published as WO87/00797 on Feb. 12, 1987, abandoned.

[30] Foreign Application Priority Data

Aug. 10, 1985 [JP] Japan ..... 60-176283

[51] Int. Cl.[5] ..... B41M 5/26

[52] U.S. Cl. ..... 156/240; 156/234; 156/277; 427/265; 428/195; 428/373; 428/327; 428/484; 428/488.4; 428/913; 428/914

[58] Field of Search ..... 428/195, 207, 484, 488.1, 428/488.4, 913, 914, 206, 323, 327; 346/1.1; 156/230, 234, 239, 240, 277; 427/265

[56] References Cited

U.S. PATENT DOCUMENTS 3,689,316 9/1972 Fellows ..... 117/234
4,698,268 10/1987 Ueyama ..... 428/484
4,732,815 3/1988 Mizobuchi ..... 428/484
4,778,729 10/1988 Mizobuchi ..... 428/484

FOREIGN PATENT DOCUMENTS 61-258789 11/1976 Japan .
56-121791 9/1981 Japan .
61-51387 3/1986 Japan .
61-51388 3/1986 Japan .

*Primary Examiner*—Pamela R. Schwartz
*Attorney, Agent, or Firm*—Armstrong, Nikaido, Marmelstein, Kubovcik & Murray

[57] ABSTRACT

A heat-sensitive melt-transfer recording medium comprising a support (1) and a heat-sensitive melt-transfer ink layer (2) provided on one side thereof is disclosed. The above-mentioned heat-sensitive melt-transfer ink layer (2) comprises a colored ink layer (3) and a layer (4) which is formed on the surface of the colored ink layer (3) and which comprises a wax in the form of microcrystals as a main component, for preventing a smudge of a receiving medium is transfer recording and for obtaining a good print with a small printing energy. This recording medium is used for a heat-sensitive melt-transfer recording system using a thermal head.

2 Claims, 1 Drawing Sheet

METHOD OF USING A HEAT-SENSITIVE MELT-TRANSFER RECORDING MEDIUM

This application is a continuation of application Ser. No. 046,814 filed as PCT JP86/00411 on Aug. 9, 1986, published as WO87/00797 on Feb. 12, 1987, now abandoned.

TECHNICAL FIELD

The present invention relates to a heat-sensitive melt-transfer recording medium. More particularly, it relates to a heat-sensitive melt-transfer recording medium for use in a heat-sensitive melt-transfer recording method using a thermal head which is adopted in a printer of a computer, a typewriter or the like.

BACKGROUND ART

Heretofore there was proposed a heat-sensitive melt-transfer recording medium wherein a layer of a wax in the form of film was provided on the surface of a heat-meltable colored ink layer to prevent the so-called smudge of a receiving medium, which means the phenomenon that the colored ink layer is transferred to areas of the receiving medium on which no print is to be formed, as disclosed, for instance, in Japanese Unexamined Patent Publication No. 59-114098 and No. 60-97888.

In the case of the conventional medium having such two-layered construction, a coating amount of not less than 3 g/m$^2$, preferably from 5 to 8 g/m$^2$, for the wax layer is required to prevent the smudge.

However, when such a thick wax layer is provided on the colored ink layer, a large quantity of printing energy is required to melt the wax layer for transferring.

When the ink layer is melted with such a small quantity of energy as required for transferring an ink layer of a recording medium wherein no such surface layer is provided, there arises the problem that the ink layer is not transferred satisfactorily, which results in a lowering of the density of a print. When the printing energy is increased in order to solve the problem, there arises another problem that the use of a recording medium having a thick wax layer gives rise to blurring of a print, which results in an impossibility of obtaining a clear print.

It is an object of the present invention to provide a heat-sensitive melt-transfer recording medium which is capable of preventing a receiving medium from smudging and of providing a good print with a small quantity of printing energy.

DISCLOSURE OF THE INVENTION

The present invention provides a heat-sensitive melt-transfer recording medium comprising a support and a heat-sensitive melt-transfer ink layer provided on one side thereof, said ink layer comprising a colored ink layer and a layer which is formed on the surface of said colored ink layer and which comprises a wax in the form of microcrystals as a main component.

Figure 1:
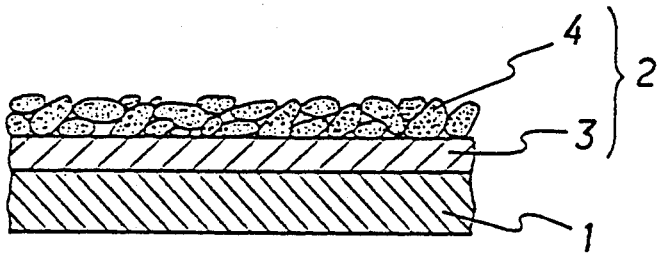
FIG. 1 is a partial cross-section showing an embodiment of the heat-sensitive melt-transfer recording medium of the present invention.

In accordance with the present invention, the layer composed of a wax in the form of microcrystals can prevent sufficiently a smudge of a receiving medium, when the thickness is in the order of 0.2 to 1 g/m$^2$.

Accordingly, a clear print with a high density can be obtained with such a small quantity of printing energy as required for printing using a recording medium wherein no wax layer is provided.

The heat-sensitive melt-transfer recording medium (hereinafter referred to as "recording medium") of the present invention comprises a support (1) and a heatsensitive melt-transfer ink layer (2), as shown in FIG. 1.

As the above-mentioned support (1), there can be suitably employed resin films with a thickness of 2 to 10 μm, including polyester film, polycarbonate film, polyamide film, polyimide film and polyphenylene sulfide film, high density papers with a thickness of 5 to 25 μm, including condenser paper, glassine paper and india paper and cellophane with a thickness of 5 to 25 μm. These materials are well known conventionally as a support for recording medium.

The above-mentioned heat-sensitive melt-transfer ink layer (2) comprises a colored ink layer (3) and a layer which is provided on the surface thereof and which is composed of a wax in the form of microcrystals as a main component (hereinafter referred to as "crystalline wax layer (4)").

The colored ink layer (3) is formed by dispersing and mixing a coloring agent including pigment and/or dye, and if necessary, a softening agent such as oil, into a wax and/or a heat-meltable resin and applying the resulting mixture onto one side of the support (1) preferably in a coating amount (the value calculated in terms of solid content) of about 2 to 7 g/m$^2$. These components are known conventionally.

The crystalline wax layer (4) is a layer formed by applying a wax in the form of microcrystals onto the surface of the above-mentioned colored ink layer (3). The preferred coating amount (the value calculated in terms of solid content) is from 0.1 to 2 g/m$^2$, especially from 0.2 to 1 g/m$^2$. When the coating amount is too small, a smudge is apt to take place. When the coating amount is too large, there is a possibility to invite reduction of a transfer sensitivity. Accordingly both cases are unfavorable.

As a method for preparing the wax in the form of microcrystals, there is adopted preferably a method wherein a wax is dissolved into an appropriate solvent by heating, and, thereafter, the resulting solution is cooled rapidly or a non-solvent is added to the solution to precipitate microcrystals.

The thus obtained solution containing microcrystals of the wax may be used for coating as such. However, the use of a dispersion obtained by treating the solution containing the wax crystals by means of a dispersing or crushing apparatus such as attritor, ball mill and homogenizer to divide the wax crystals more finely and uniformly is more effective for preventing smudge to obtain a clear print.

The size (the average particle size measured by Coulter counter method, hereinafter the same) of the wax crystals is preferably from 0.01 to 5 μm, more preferably from 0.1 to 4 μm. When the size of the wax crystals is larger than the above range, the crystalline wax layer (4) is apt to become thick, which leads to an insufficient transfer so that a clear print is hardly obtained. When the size of the wax crytals is smaller than the above range, the crystalline wax layer (4) is apt to become a film-like layer and, as a result, a smudge takes place if the coating amount is not large.

The thus prepared wax crystals-containing solution is applied to the surface of the colored ink layer (3) previously formed on the support (1) by an appropriate coating method, and then heated at such a temperature that the wax is not dissolved to remove the solvent, thereby forming a crystalline wax layer (4) on the colored ink layer (3).

Any conventional coating method such as Meyer bar coating, gravure coating or a method using reverse coater may be used as the above-mentioned coating method.

Examples of the wax used in the present invention include vegetable waxes such as candelilla wax, carnauba wax, rice wax and Japan wax; animal waxes such as bees wax, lanolin and whale wax; mineral waxes such as montan wax; petroleum waxes such as paraffin wax and microcrystalline wax; higher fatty acids such as palmitic acid, stearic acid and behenic acid; higher alcohols such as palmityl alcohol, stearyl alcohol and behenyl alcohol; higher fatty acid esters such as methyl stearate, cetyl stearate and myricyl palmitate; amide waxes such as stearoyl amide and palmitic acid amide; and synthetic waxes such as polyethylene wax, coal wax and Fischer-Tropsch wax. These waxes may be used singly or as admixtures thereof.

Thus, the term "wax' intended in the present invention is a concept encompassing wax-like substances as well as normal waxes.

For the purpose of improving an adhesiveness to the colored ink layer (3), etc, if necessary, a heatmeltable resin having a softening point of about 40° to 120° C. may be added to the wax in an amount of 1 to 20 parts (parts by weight, hereinafter the same) per 100 parts of the wax. An excessively high proportion of the heat-meltable resin is undesirable, because it is apt to invite the problem that microcrystals of the wax are not formed or the problem that the transfer sensitivity is reduced.

Examples of the heat-meltable resin include rosins and derivatives thereof, polyamide resins, acrylic resins, phenolic resins, xylene resins, cellulosic resins, vinyl acetate resins and butyral resins. These resins may be used singly or as admixtures thereof.

Moreover, for the purpose of adjusting the strength of the crystalline wax layer (4), if necessary, a white pigment or body pigment including silica, alumina, titanium oxide, zinc oxide, calcium carbonate and barium carbonate may be added as an additive in an amount of about 5 to 100 parts, preferably about 5 to 20 parts, per 100 parts of the wax. An excessively high proportion of the additive is undesirable, because the problem that microcrystals of the wax are not formed or the problem that the crystalline wax layer (4) is too brittle is apt to occur.

Examples of the solvent used to dissolve the wax include toluene, benzene, xylene, ethyl acetate, methyl ethyl ketone, tetrahydrofuran and acetone. These solvents are suitably selected depending upon the kind of the wax used.

Examples of the non-solvent of the wax include water, alcohols (methanol, ethanol, isopropyl alcohol, butanol and others), ethyl acetate, n-heptane, n-octane, cyclohexane and dioxane. These non-solvents are suitably selected depending upon the kind of the wax used.

There is a possibility that some of the abovementioned solvents become a non-solvent or some of the above-mentioned non-solvents become a solvent, depending upon the kind of the wax used. Therefore, the abovementioned solvents and non-solvents are merely examples.

Generally papers are used as a receiving medium used in printing by using the recording medium of the present invention. Especially it has been found that when the recording medium of the present invention was used, a clear print was obtained with no smudge on a resin film for use in an overhead projector (hereinafter referred to as "OHP").

BEST MODE FOR CARRYING OUT THE INVENTION

The present invention will be explained by referring to the following Examples and Comparative Examples.

EXAMPLE 1

The colored ink with the formulation mentioned below was applied in a coating amount of 3.5 g/m$^2$ onto a polyethylene terephthalate film (1) having a thickness of 6 μm by means of a hot-melt coater to form a colored ink layer (3).

| Formulation of colored ink layer | Parts |
|---|---|
| Paraffin wax 155 F | 12 |
| Carnauba wax | 3 |
| Ethylene-vinyl acetate copolymer | 2 |
| Carbon black | 3 |

Into 2 parts of toluene heated to 80° C. was dissolved 1 part of an oxidized wax (commercial name "PO WAX H-10", made by NIPPON OIL COMPANY, LTD.). To the resultant was added 7 parts of isopropyl alcohol at a temperature higher than 50° C. to give a suspension wherein microcrystals (size: 1.5 μm) of the oxidized wax were precipitated.

The suspension was applied onto the surface of the colored ink layer (3) by means of Meyer bar so that the coating amount after being dried was 0.7 g /m$^2$ and then treated for 20 seconds in a hot air drier kept at 60° C. to remove the solvent substantially completely, thereby forming a crystalline wax layer (4).

Employing the thus obtained sample, printing was conducted using an electrostatic copying paper (commercial name "Xerox M", made by FUJI XEROX CO., LTD.) as a receiving medium in a heat transfer printing type word processor WD-200 made by Sharp Corporation at a room temperature. As a result, the print image formed on the receiving medium showed an OD value of about 1.1 as measured by a Macbeth densitometer RD 514 and a clear print with no blurring was obtained.

Further there were no traces that the colored ink was transferred to areas other than the prescribed image-bearing areas, namely no so-called smudge occurred.

COMPARATIVE EXAMPLE 1

Onto the surface of a colored ink layer (3) formed in the same manner as in Example 1 was applied PO WAX H-10 in a coating amount of 1.0 g/m$^2$ by a hot-melt coating method to form a film-like wax layer on the surface of the colored ink layer (3).

Employing the obtained sample, a printing test was conducted in the same manner as in Example 1. As a result, smudges were frequent and the density of the print was 0.95.

COMPARATIVE EXAMPLE 2

Onto the surface of a colored ink layer (3) formed in the same manner as in Example 1 was applied PO WAX H-10 in a coating amount of 3.0 g/m$^2$ by a hot-melt coating method to form a film-like wax layer on the surface of the colored ink layer (3).

Employing the obtained sample, a printing test was conducted in the same manner as in Example 1. As a result, the obtained print was pale such that the density thereof was 0.5, though no smudge occurred.

EXAMPLE 2

Onto the surface of a colored ink layer (3) formed in the same manner as in Example 1 was formed a crystalline wax layer (4) in the manner as described below.

Into 6 parts of toluene heated to 80° C. were dissolved 1 part of candelilla wax and 1 part of carnauba wax. While the resultant was still hot at a temperature higher than 50° C., 12 parts of methanol was added thereto to obtain a suspension wherein microcrystals of the wax were precipitated. The suspension was subjected to a crushing treatment in an attritor filled with glass beads for about 30 minutes.

The suspension (size of wax crystals: 3.6 μm) thus subjected to the crushing treatment was applied onto the surface of the colored ink layer (3) by means of Meyer bar so that the coating amount after being dried was 1.0 g/m$^2$ and then treated for 20 seconds in a hot air drier kept at 60° C. to remove the solvent substantially completely, thereby forming a crystalline wax layer (4).

Employing the thus obtained sample, a printing test was conducted in the same manner as in Example 1. As a result, no smudge occurred and a clear print having a density of 1.0 was obtained.

EXAMPLE 3

Onto the surface of a colored ink layer (3) formed in the same manner as in Example 1 was formed a crystalline wax layer (4) in the manner as described below.

Into 7 parts of toluene heated to 70° C. was dissolved 4 parts of candelilla wax. While the resultant was still hot at a temperature higher than 50° C., 25 parts of methanol was added thereto to obtain a suspension wherein microcrystals (size: 2.5 μm) of the wax were precipitated.

To the suspension was added 4 parts of a resinous solution prepared by dissolving 1 part of polyvinyl alcohol (commercial name "UMR-10L", made by UNITIKA CHEMICAL KABUSHIKI KAISHA) into 9 parts of methanol. The resulting mixture was agitated for 10 minutes by means of a homogenizer.

The suspension mixed with the resin was applied onto the surface of the colored ink layer (3) by means of Meyer bar so that the coating amount after being dried was 0.3 g/m$^2$ and then treated for 20 seconds in a hot air drier kept at 60° C. to remove the solvent substantially completely, thereby forming a crystalline wax layer (4).

Employing the thus obtained sample, a printing test was conducted in the same manner as in Example 1. As a result, no smudge occurred and a clear print having a density of 1.1 was obtained.

EXAMPLE 4

Employing each of the recording media obtained in Examples 1 to 3, printing was conducted on an OHP film (commercial name "Xerox Film", made by FUJI XEROX CO., LTD.) in a printer for OHP film (No. 842 made by KYOCERA CORPORATION). As a result, a clear print, particularly being clear in parts of thin lines, was obtained and no smudge occurred.

COMPARATIVE EXAMPLE 3

Employing the recording medium obtained in Comparative Example 2, printing was conducted on the OHP film in the same manner as in Example 4. As a result, though no smudge occurred, the obtained print was unclear, particularly in parts of thin lines and therefore it was not fit for practical use.

COMPARATIVE EXAMPLE 4

A recording medium which was the same as in Example 1 except that the crystalline wax layer (4) was not provided on the colored ink layer (3) was produced. Employing the recording medium, printing was conducted on the OHP film in the same manner as in Example 4. As a result, the obtained print was unclear, particularly in parts of thin lines.

We claim:

1. A process for producing printed images on a film for an overhead projector which comprises:

providing a heat-sensitive melt-transfer recording medium comprising a support and a heat-sensitive melt-transfer ink layer provided on one side thereof, said ink layer comprising a colored ink layer (A) containing a wax and a layer (B) which is formed on the surface of said colored ink layer (A) and which comprises a wax in the form of microcrystals as a main component, wherein said layer (B) is formed by applying onto the ink layer (A) a dispersion of a wax in the form of microcrystals in a medium comprising at least a solvent for said wax and drying the resultant wet layer at a temperature at which the wax microcrystals do not dissolve and the amount of said layer (B) is from 0.1 to 2 g/m$^2$ of the surface of said colored ink layer (A); and transferring said heat-sensitive melt-transfer ink layer from said recording medium to a film for an overhead projector by application of heat to give a printed image on the film wherein said layer (B) containing said wax is adjacent to the film.

2. The process of claim 1, wherein the size of the microcrystals of wax in the layer (B) is from 0.01 to 5 μm.

* * * * *